US007156758B2

(12) United States Patent
Lu

(10) Patent No.: US 7,156,758 B2
(45) Date of Patent: Jan. 2, 2007

(54) DURABLE GOLF TEE

(76) Inventor: Alex Lu, 2255 Huntley Cir., San Marino, CA (US) 91108

( * ) Notice: Subject to any disclaimer, the term of this patent is extended or adjusted under 35 U.S.C. 154(b) by 34 days.

(21) Appl. No.: 10/988,272

(22) Filed: Nov. 13, 2004

(65) Prior Publication Data

US 2006/0105860 A1 May 18, 2006

(51) Int. Cl.
*A63B 57/00* (2006.01)

(52) U.S. Cl. ..... 473/396; 473/401

(58) Field of Classification Search ..... 473/386–403, 473/417

See application file for complete search history.

(56) References Cited

U.S. PATENT DOCUMENTS

| | | | | |
|---|---|---|---|---|
| 1,807,377 | A * | 5/1931 | Brokaw | 473/397 |
| 2,839,304 | A * | 6/1958 | Lerick | 473/397 |
| 3,079,158 | A * | 2/1963 | Finn et al. | 473/396 |
| 4,819,938 | A * | 4/1989 | Hill | 473/386 |
| 6,893,363 | B1 * | 5/2005 | Chen et al. | 473/417 |
| 2003/0181262 | A1 * | 9/2003 | Lee | 473/396 |
| 2005/0181893 | A1 * | 8/2005 | Slaven | 473/387 |

* cited by examiner

*Primary Examiner*—Steven Wong
(74) *Attorney, Agent, or Firm*—Roger C. Turner

(57) ABSTRACT

An improved durable golf tee comprises a separate upper portion and a separate lower portion that are axially aligned and enclosed within a flexible collar. The upper portion has an upper end for supporting a golf ball, an upper shank and a lower end having an upper annular flange. The lower portion has a pointed lower end for inserting the tee into the ground, a lower shank and an upper end having a lower annular flange. The flexible collar encloses the lower end of the upper portion and the upper end of the lower portion, forming an integral golf tee, whereby the upper portion and the lower portion are independently flexible within the collar.

In a second embodiment, the interior tee portions are molded as a single tee component having the upper portion and the lower portion interconnected by a reduced-diameter (break-away) center portion. The center portion and the respective inner ends of the upper and lower portions are enclosed within the flexible collar. Once the break-away center portion is fractured, the upper portion and the lower portion are independently flexible within the flexible collar.

The durable golf tee is formed by a method including the steps of: molding the upper portion and lower portion of a strong, tough plastic (nylon) material; and over-molding the upper shank, upper flange, lower shank, and lower flange with a flexible (rubber) collar.

9 Claims, 4 Drawing Sheets

DURABLE GOLF TEE

BACKGROUND OF THE INVENTION

The invention relates to a golf tee for supporting a golf ball for driving; particularly to a golf tee that is durable for withstanding numerous hits and having an extended long useful life.

A golf tee for supporting a golf ball for driving the ball from the tee box is well known and has long been in use. A golf tee is typically fabricated from wood having a shank diameter of about 0.15 to 0.19 inches, a length of about 2.50 to 3.00 inches, having an upper end in the shape of a 0.50 inch diameter cup for supporting a golf ball, and a pointed lower tip for inserting the tee into the ground at the tee box.

A problem associated with the tee is that the golf club usually hits the upper end of the tee, as well as the ball, and the tee is chipped, broken or driven from the ground and lost during the swing of the club. A typical tee is only useful for a few drives of the ball, and the golfer requires numerous tees for playing a round of golf.

There have been previous attempts to design and develop a more durable golf tee, as illustrated in U.S. Pat. No. 5,186,455 in which a composite cushioning collar is provided, and a conventional wooden tee is inserted through the central opening of the collar to protect the shank of the tee. The collar seems to absorb some impact of the club, but the rigid wooden tee remains exposed to be chipped or broken, particularly above and below the collar.

Another prior art design is illustrated in U.S. Pat. No. 6,341,752 in which a golf tee support includes a rectangular block housing having an upper end for receiving a golf tee for supporting a golf ball, and a lower end that is inserted into the ground and inter-connected to the block by a flexible spring. After impact, the support is deflected but remains in position after the ball is hit. This support includes four components and is dependent on the integrity of the spring for any additional use.

Another prior art design is illustrated in U.S. Pat. No. 5,242,170 in which a two piece golf tee includes a lower plastic piece that is inserted into the ground and having an extended flexible retainer shaft; and an upper plastic sleeve is slideably positioned on the flexible shaft for supporting the golf ball. On impact, the upper sleeve is deflected and slides to the end of the flexible shaft of the lower plastic piece. The components are snapped together on assembly, and can be snapped apart on impact. The two movable pieces may need to be reassembled or repositioned after each use.

In view of the foregoing, it is an object of the present invention to provide a durable golf tee that has a compressible collar to absorb the initial impact of a golf club, that is also flexible internally to further absorb the impact, and is molded of tough material to resist chipping and breakage during repeated uses.

It is another object to provide a durable golf tee that is of an integral one-piece final assembly that has no moving parts or deformable parts, for consistent repeatable use.

It is another object to provide a durable golf tee that is robust to tool and mold, can be efficiently manufactured, and that can be marketed at a reasonable price.

SUMMARY OF THE INVENTION

The foregoing objects are accomplished by a first embodiment of an improved durable golf tee comprising a separate upper portion and a separate lower portion that are axially aligned and enclosed within a flexible collar.

The upper portion has an upper end for supporting a golf ball, an upper shank and a lower end having an upper annular flange, and a lower tip. The lower portion has a pointed lower end for inserting the tee into the ground, a lower shank and an upper end having a lower annular flange and an upper tip. The upper portion and lower portion are suitably molded from a high-temperature, strong, tough material such as nylon.

The flexible collar encloses the lower end of the upper portion and the upper end of the lower portion, forming an integral golf tee, whereby the upper portion and the lower portion are independently flexible within the collar. The flexible collar is suitably molded from a silicone compound or a rubber compound. The collar can be molded as a separate component or preferably molded over the aligned upper portion and lower portion.

In a second embodiment, the interior tee portions are molded as a single tee component having an upper portion and a lower portion that are interconnected by a reduced-diameter (break-away) center portion. The center portion and the respective inner ends of the upper and lower portions are enclosed within the flexible collar.

The interior golf tee component has the upper portion with an upper end for supporting a golf ball, an upper shank with an upper annular flange thereon; and has the lower portion with a pointed lower end for inserting the tee into the ground, a lower shank having an annular lower flange thereon, wherein the upper portion and the lower portion are interconnected by a break-away center portion. Similarly to the first embodiment, a flexible collar encloses the lower end of the upper portion, the break-away center portion, and the upper end of the lower portion. Once the break-away center portion is fractured, the upper portion and the lower portion are independently flexible within the flexible collar.

The durable golf tee of the present invention can suitably be formed by a method comprising the steps of: molding an upper portion with an upper end for supporting a golf ball, an upper shank with an upper annular flange thereon, of a suitable strong, tough plastic material; and molding a lower portion with a pointed lower end for inserting the tee into the ground, a lower shank having an annular flange thereon, of a suitable strong, tough plastic material; and over-molding the upper shank, upper flange, lower shank, and lower flange with a flexible collar. The flexible collar is over-molded with a suitable silicone compound or rubber compound.

The method for forming a durable golf tee can further include the steps of, molding a break-away center portion interconnecting the upper portion and the lower portion into a single component prior to the step of over-molding with the flexible collar.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
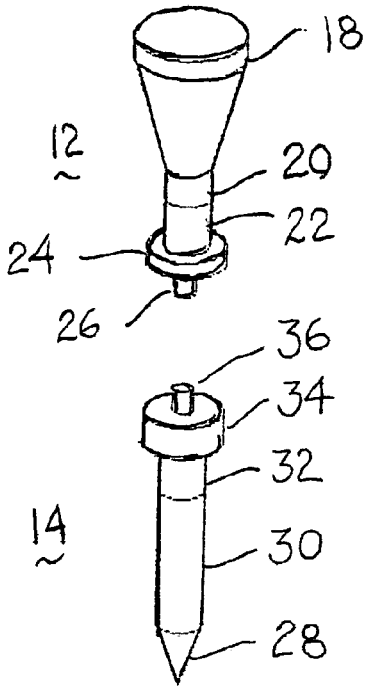
FIG. 1 is a front perspective view of the two internal components of a first embodiment of the present invention.
Figure 2:
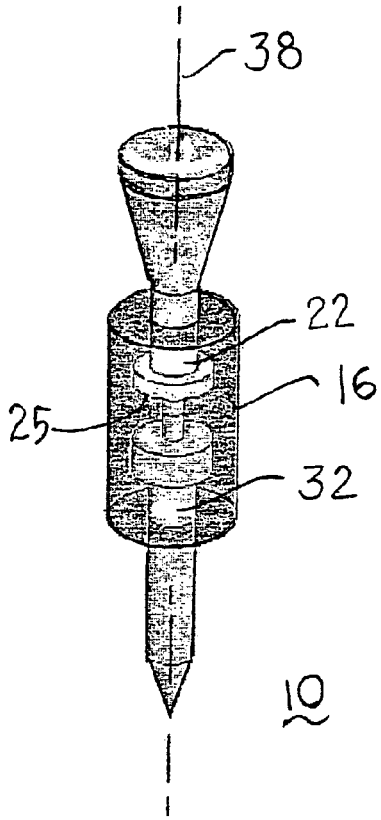
FIG. 2 is a front perspective view of the a first embodiment of the durable golf tee of the present invention.

Referring first to FIGS. 1 and 2, there is shown an example of a first embodiment of a durable golf tee 10 of the present invention. This first embodiment has interior tee portions comprising a separate upper portion 12 and a separate lower portion 14 that are axially aligned and enclosed within a flexible collar 16.

The upper portion 12 has an upper end 18 for supporting a golf ball, an upper shank 20 and a lower end 22 having an upper annular flange 24, and an optional reduced diameter lower tip 26. The upper portion is preferably formed of a strong tough plastic material such as nylon, Delran, abs, etc., to resist breaking or chipping when struck by a golf club.

The lower portion 14 has a pointed lower end 28 for inserting the tee into the ground, a lower shank 30 and an upper end 32 having a lower annular flange 34 and an optional reduced diameter upper tip 36. The lower portion is also formed of a strong tough plastic material.

The upper shank 20 and the lower shank 30 are longitudinally aligned along a common axis 38 and are preferably positioned with the upper tip 26 of the upper portion abutting the lower tip 36 of the lower portion. The lower end 22 of the upper portion and the upper end 32 of the lower portion are enclosed within the large flexible collar 16, formed from a suitable silicone or rubber elastomeric compound resulting in an integral golf tee.

Figure 1A:
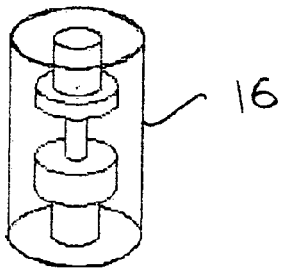
FIG. 1A is a front perspective view of the flexible collar, molded as a separate component.

The flexible collar 16 could be fabricated as a separate component, as shown in FIG. 1A, having a central cavity for receiving the respective shanks and flanges, and the upper and the lower portion could be forced into these internal cavities of the collar. However, the durable golf tee of the present invention is preferable formed into an integral component by the well known over-molding process. In this method, the upper portion and the lower portion are suitably molded from a relatively high-temperature tough material such as nylon; Delran, abs, etc., and the portions are then transferred into another mold that properly spaces and aligns these portions and includes a cavity for over-molding the collar (suitably cylindrical in the present invention). The mold is then closed and sealed around the shanks of the upper and lower portions, and the silicone or rubber compound, having a temperature cooler than the melting temperature of the interior tee portions, is injected into the cavity. The compound is over-molded around the respective lower end and upper end of the tee portions, particularly enclosing the flanges, to lock the respective portions within the collar. When the compound is suitably cured and cooled, a durable golf tee is provided having the previously discussed features, and which is integrally bonded and will not become separated upon numerous impacts by a golf club.

The flexible collar 16 is suitably cylindrical in shape having a diameter of about 0.50 inches and a length of about 0.75 inches. The flexible collar provides a direct cushion to absorb and distribute the impact of the golf club, and the collar can flex at the junction of the upper and lower portions to absorb impact; and the upper portion can also flex independently within the flexible collar to further deflect the impact of the club. The upper flange 24 can further include a convex lower surface 25 to facilitate lateral rotation of the upper member within the flexible collar. Thus, the tough interior portions and the flexible collar function to absorb distribute and deflect the impact of the golf club resulting in the durable golf tee of the present invention.

There are several other suitable junctions of the lower end of the upper portion 12 and the upper end of the lower portion 14 within the flexible collar 16. The optional upper tip (36) on the lower portion can be eliminated, and the lower end 22 on the upper portion includes the reduced diameter cylindrical tip 26 that extends to abut the lower annular flange 34. Alternatively, the optional lower tip (26) on the upper portion can instead be eliminated, and the upper end 32 on the lower portion includes the reduced diameter cylindrical tip 36 that extends to abut the upper annular flange 24. As a further suitable variation of this embodiment, both the optional upper tip (36) and the optional lower tip (26) may be eliminated, and the upper portion and the lower portions can be separated about 0.13 inches and encased within the flexible collar 16. Each of these variations provides a slightly unique flexure, but function in a similar manner to permit the absorption and flexure of the lateral impact of the golf club.

The upper portion 12 and the lower portion 14 are relatively firm and stable in the longitudinal direction for easy insertion of the lower end 28 into the ground, and for supporting the ball at the upper end 18; and are independently flexible in the lateral direction within the flexible collar 16.

Figure 3:
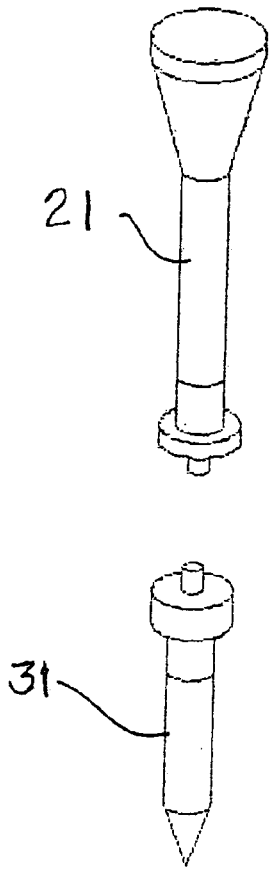
FIG. 3 is a front perspective view of the two internal components of the first embodiment having an extended length.
Figure 4:
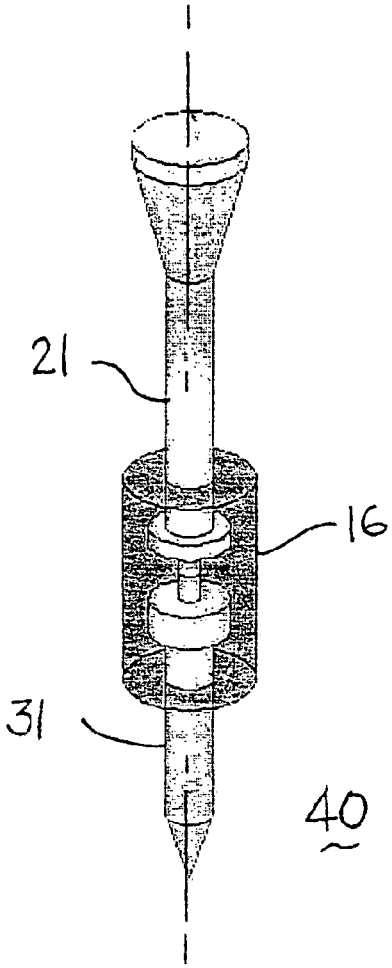
FIG. 4 is a front perspective view of the a first embodiment of the durable golf tee of the present invention, having an extended length.

Referring now to FIGS. 3 and 4, there is shown another variation of a first embodiment of a durable golf tee 40 of the present invention. In this variation, the upper portion is molded having an elongated shank 21 for an elevated durable golf tee about 2.75 inches in length, particularly useful for large headed drivers. The upper portion, lower portion and flexible collar 16 are otherwise as described in reference to FIGS. 1 and 2. The additional elevation can alternatively be provided wherein, the lower portion is molded having an elongated shank 31, and the upper and lower portions, and flexible collar are otherwise as described in reference to FIGS. 1 and 2.

Figure 5:
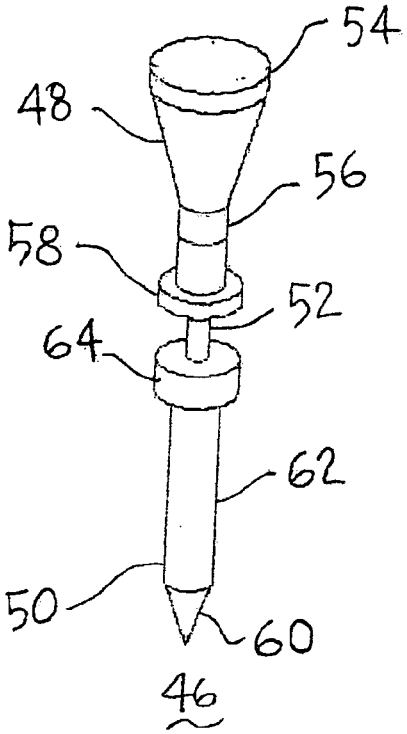
FIG. 5 is a front perspective view of a one-piece internal component of a second embodiment of the present invention.
Figure 6:
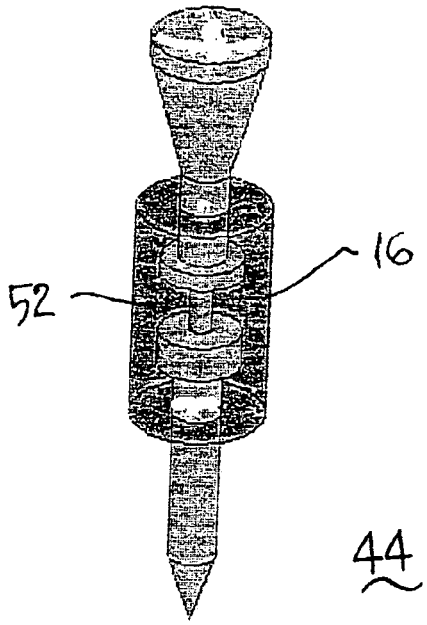
FIG. 6 is a front perspective view of the second embodiment of the durable golf tee of the present invention.

Referring now to FIGS. 5 and 6, there is shown an example of a second embodiment of the durable golf tee 44 of the present invention. The second embodiment features interior tee portions that are molded as a single tee component 46 having an upper portion 48 and a lower portion 50 that are interconnected by a reduced-diameter (break-away) center portion 52. The center portion and the respective inner ends of the upper and lower portions are enclosed within the flexible collar 16.

The interior tee component 46 is suitably about 2.25 inches in length, and has the upper portion 48 suitably about 0.94 inches in length, with an upper end 54 for supporting a golf ball, an upper shank 56 having a diameter of about 0.19 inches, with an upper annular flange 58 having a diameter of about 0.31 inches. The component includes the lower portion 50 suitably having a length of about 1.00 inches with a pointed lower end 60 for inserting the tee into the ground, and having a lower shank 62 having a diameter of about 0.19 inches, and having an annular flange 64 with a suitable diameter of about 0.31 inches. The break-away center portion 52 is about 0.13 in length and has a suitable diameter of about 0.09 inches.

The flexible collar 16 encases the lower end of the upper portion 48, the center portion 52 and the upper end of the lower portion 50 similarly as described in reference to FIGS. 1 and 2 to form the second embodiment of the durable golf tee 44.

The reduced-diameter, break-away center portion 52 provides several advantages in the manufacturing and function of the durable golf tee. The interior component 46 can be tooled and molded as a single component (rather than the two separate portions as in the first embodiment). The upper and lower portions are initially interconnected so they remain in perfect spacing and alignment during handling and during the over-molding processes of bonding the flexible collar. The break-away center portion is preferably provided by the reduced-diameter shaft, but could alternatively be provided by a suitable notched or slotted portion (not shown) that can be readily fractured upon flexure.

The second embodiment of the present invention 44 is produced by a similar method and steps as that of the first embodiment. The steps include molding the interior component 46 of a durable, tough, high-melting temperature plastic material, such as nylon, Delran, abs, etc., transferring the molded component into a tool for receiving the component and having a cavity in the shape of the collar; then over-molding with a silicone or rubber compound around the upper flange 58, the center portion 52 and the lower flange 64. Once the over-mold compound is cured and cooled, the break-away center portion is fractured (by hand, or upon first impact by a golf club) to complete the formation of the second embodiment of the durable golf tee of the present invention, as further described below.

Once the flexible collar 16 is bonded to the interior component 46, the golf tee can be readily flexed by hand to fracture the break-away portion 52, resulting in the upper portion 48 and the lower portion 50 being independently flexible within the collar. Although the center portion is fractured, it remains captured in position by the molded collar, and the durable tee remains firm and stable in the longitudinal direction, and flexible in the lateral direction.

Figure 7:
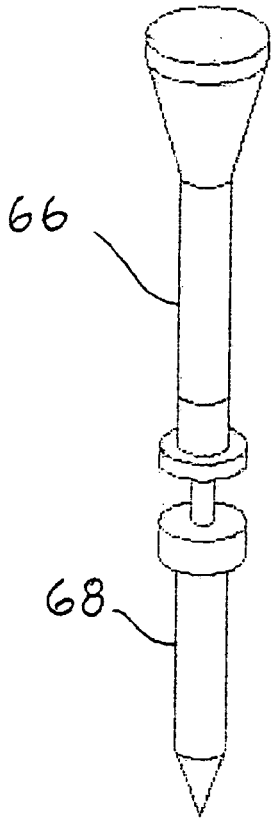
FIG. 7 is a front perspective view of the one-piece internal component of the second embodiment of the present invention, having an extended length.
Figure 8:
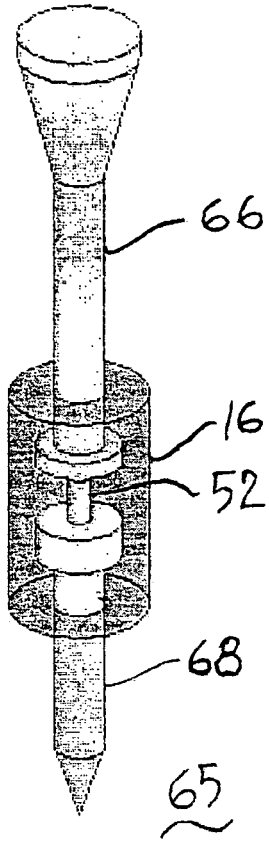
FIG. 8 is a front perspective view of the second embodiment of the durable golf tee of the present invention having an extended length.

Referring now to FIGS. 7 and 8, there is shown another variation of a second embodiment of a durable golf tee 65 of the present invention. In this variation, the upper portion is molded having an elongated shank 66 for an elevated durable golf tee about 2.75 inches in length, particularly useful for large headed drivers. The upper portion, center portion 52, lower portion and flexible collar 16 are otherwise as described in reference to FIGS. 5 and 6. The additional elevation can alternatively be provided wherein, the lower portion is molded having an elongated shank 68, and the upper, center and lower portions, and the flexible collar are otherwise as described in reference to FIGS. 5 and 6.

The foregoing example of the present invention provides a durable golf tee that has a compressible collar to absorb the initial impact of a golf club, that is also flexible internally to further absorb the impact, and is molded of tough material to resist chipping and breakage during repeated uses. The present invention further provides a durable golf tee that is of an integral one-piece final assembly that has no moving parts or deformable parts, for consistent repeatable use. The durable golf tee is robust to tool and mold, and can be efficiently manufactured, and marketed at a reasonable price.

While specific embodiments and examples of the present invention have been illustrated and described herein, it is realized that modifications and changes will occur to those skilled in the art. It is therefore to be understood that the appended claims are intended to cover all such modifications and changes as fall within the spirit and scope of the invention.

The invention claimed is:

1. A durable golf tee, comprising:

an upper portion having an upper end for supporting a golf ball, an upper shank and a lower end having an upper annular flange, and a lower tip thereon;

a lower portion having a pointed lower end for inserting the tee into the ground, a lower shank and an upper end having a lower annular flange and an upper tip thereon, with the lower shank aligned with the upper shank of said upper portion; and a flexible elastomeric collar molded over and surrounding the lower end of said upper portion and the upper end of said lower portion, forming an integral golf tee, whereby the upper annular flange of said upper portion and the lower annular flange of said lower portion are securely retained within said collar.

2. A durable golf tee as defined in claim 1, wherein the lower tip on the lower end of said upper portion includes a reduced diameter cylindrical tip.

3. A durable golf tee as defined in claim 1, wherein the upper tip on the upper end of said lower portion further includes a reduced diameter cylindrical tip.

4. A durable golf tee as defined in claim 1, wherein the lower end of said upper portion further includes a reduced diameter cylindrical tip, and the upper end of said lower portion further includes a reduced diameter cylindrical tip.

5. A durable golf tee as defined in claim 1, wherein said upper portion has an extended shank for providing a tall golf tee.

6. A durable golf tee, comprising:

a golf tee component having an upper portion with an upper end for supporting a golf ball, an upper shank with an upper annular flange thereon; and having a lower portion with a pointed lower end for inserting the tee into the ground, a lower shank with a lower annular flange thereon, wherein said upper portion and said lower portion are interconnected by a break-away center portion; and a flexible elastomeric collar molded over and surrounding the lower end of said upper portion, the break-away center portion, and the upper end of said lower portion, wherein said breakaway center portion is readily breakable, whereby said upper portion and said lower portion are readily flexible within said collar.

7. A durable golf tee as defined in claim 6, wherein said upper portion has an extended shank for providing a tall golf tee.

8. A method for forming a durable golf tee, comprising the steps of:

molding an upper portion with an upper end for supporting a golf ball, an upper shank with an upper annular flange thereon;

molding a lower portion with a pointed lower end for inserting the tee into the ground, a lower shank having an annular flange thereon; and over-molding the upper shank, upper flange, lower shank, and lower flange with a flexible elastomeric collar.

9. A method for forming a durable golf tee comprising the steps of:

molding an upper portion with an upper end for supporting a golf ball, an upper shank with an upper annular flange thereon;

and molding a lower portion with a pointed lower end for inserting the tee into the ground, a lower shank having an annular flange thereon as a single component having an interconnecting break-away center portion; and over-molding the upper shank, upper flange, lower shank, lower flange and the break-away center portion with a flexible elastomeric collar.

* * * * *